US005440843A

United States Patent [19]

Langenhorst

[11] Patent Number: 5,440,843

[45] Date of Patent: Aug. 15, 1995

[54] FIRECODE ACCESS PANEL

[75] Inventor: Christoph Langenhorst, Soest, Germany

[73] Assignee: Eva Langenhorst nee Lahrmann, Soest, Germany

[21] Appl. No.: 167,282

[22] Filed: Dec. 15, 1993

[30] Foreign Application Priority Data

Dec. 31, 1992 [DE] Germany ..... 42 44 578.7

[51] Int. Cl.[6] ..... E04B 1/94

[52] U.S. Cl. ..... 52/232; 52/220.8; 49/7; 49/463

[58] Field of Search ..... 49/467, 469, 475.1, 49/7, 8, 463, 465; 52/232, 220.8

[56] References Cited

U.S. PATENT DOCUMENTS

| | | | |
|---|---|---|---|
| 3,325,941 | 6/1967 | Prucha | 49/7 |
| 3,491,486 | 1/1970 | Caruth | 49/463 |
| 3,858,355 | 1/1975 | Root | 49/463 X |
| 4,144,688 | 3/1979 | Dixon | 49/475.1 X |
| 4,246,304 | 1/1981 | Dixon | 49/475.1 X |
| 4,679,365 | 7/1987 | Herring | 49/465 X |
| 4,850,173 | 7/1989 | Beyer et al. | 52/232 X |
| 4,931,339 | 6/1990 | Malcolm-Brown | 49/475.1 X |
| 4,998,381 | 3/1991 | Langenhorst | 49/463 |
| 5,067,278 | 11/1991 | Lyons | 49/463 |

FOREIGN PATENT DOCUMENTS

| | | | |
|---|---|---|---|
| 2247709 | 3/1992 | United Kingdom | 52/232 |

*Primary Examiner*—Carl D. Friedman
*Assistant Examiner*—Christopher Todd Kent
*Attorney, Agent, or Firm*—Herbert Dubno; Andrew Wilford

[57] ABSTRACT

The panel assembly has a panel generally fitting in a hole and having an outer periphery running generally parallel to the inner periphery of the hole. Respective geometrically similar inner and outer annular frames on the inner and outer peripheries have confronting outer faces forming an annular gap around the panel between the inner and outer frames. One of the frames has an inner face forming an annular compartment extending around the respective periphery. This one frame is formed with an array of throughgoing openings extending between the respective inner and outer faces and the compartment is substantially closed except at the openings. An annular body of heat-swellable material is provided in the compartment so that on heating of the material it swells and exits the compartments through the openings to fill the gap.

5 Claims, 2 Drawing Sheets

FIRECODE ACCESS PANEL

FIELD OF THE INVENTION

The present invention relates to an access panel. More particularly this invention concerns a firecode access-panel assembly.

BACKGROUND OF THE INVENTION

An access opening in a firecode wall, which term is here intended to cover a side Wall, floor, or ceiling, must be constructed of fireproof material and in such a manner that it does not open or let fire pass in case of a fire on one side of the wall. Thus it is known to mount on the outside edge of the door or on the inside edge of the opening a strip of foamable material, for instance a specially formulated polystyrene or polyurethane, that will swell and fill any gap between the outer periphery of the panel and the inner periphery of the hole. In case of a fire this material will therefore effectively block passage of anything past the gap around the panel.

The main disadvantage with this arrangement is that the strip is relatively exposed. Even when it is set in a groove of a frame lining the inside of the opening or surrounding the panel edge, it can be damaged relatively easily. Moisture can get to it with ease, and in the normal course of using the access panel it can be damaged to the point where it no longer functions as intended, creating a code violation.

OBJECTS OF THE INVENTION

It is therefore an object of the present invention to provide an improved firecode access-panel assembly.

Another object is the provision of such an improved firecode access-panel assembly which overcomes the above-given disadvantages, that is which will surely seal the opening around the door but where the foamable strip will not be liable to damage during normal use of the panel.

SUMMARY OF THE INVENTION

The panel assembly according to the invention has a panel generally fitting in a hole and having an outer periphery running generally parallel to the inner periphery of the hole. Respective geometrically similar inner and outer annular frames on the inner and outer peripheries have confronting outer faces forming an annular gap around the panel between the inner and outer frames. One of the frames has an inner face forming an annular compartment extending around the respective periphery. This one frame is formed with an array of throughgoing openings extending between the respective inner and outer faces and the compartment is substantially closed except at the openings. An annular body of heat-swellable material is provided in the compartment so that on heating of the material it swells and exits the compartments through the openings to fill the gap.

Thus with this arrangement the inner periphery of the opening and the outer periphery of the panel are both provided with and protected by a stiff rugged frame, normally of metal. The swellable mass is wholly contained in the compartment behind one of the frames so that it is completely out of harm's way. Nonetheless when heated the mass will swell and erupt out of the holes to effectively fill the gap and seal around the panel.

The panel and wall in accordance with this invention have generally coplanar outer Surfaces and the one frame is L-shaped with an inner leg defining the respective inner and outer faces and extending generally perpendicular to the wall and panel surfaces and an outer leg lying flatly on the respective outer surface. The one frame further comprises a stiff annular element set in the panel and defining the compartment. The body is wholly contained between the annular element and the one frame. More specifically the annular element is generally of Z-section having an outer web lying against the respective outer surface underneath the outer leg of the one frame, an inner web extending generally parallel to the surfaces and outwardly butting against the inner face of the one frame, and an intermediate web extending transversely of the surfaces, bridging the inner and outer webs, and extending generally parallel to the inner face. This very effectively protects the normally fairly soft and fragile strip forming the foamable body.

The holes are in a regular array extending around the respective periphery. They can be circular in shape or slots. The assembly is also provided according to the invention with a latch actuatable by heat to look the panel in the hole. This latch includes a spring mounted on a predetermined one of the frames and having a leg displaceable between a normal position extending from the frame it is mounted on across the other frame to block same, a holder mounted on the predetermined one of the frames and retaining the spring thereon, and a heat-fusible body in the holder normally retaining the spring leg in a retracted position wholly out of the way of the other frame. Thus when the fusible body melts the leg springs out to block the panel in the closed position The other frame is provided with a strike forming a pocket open toward the guide and receiving the spring leg in the normal position.

BRIEF DESCRIPTION OF THE DRAWINGS

The above and other objects, features, and advantages will become more readily apparent from the following description, reference being m to the accompanying drawing in which.

SPECIFIC DESCRIPTION

Figure 1:
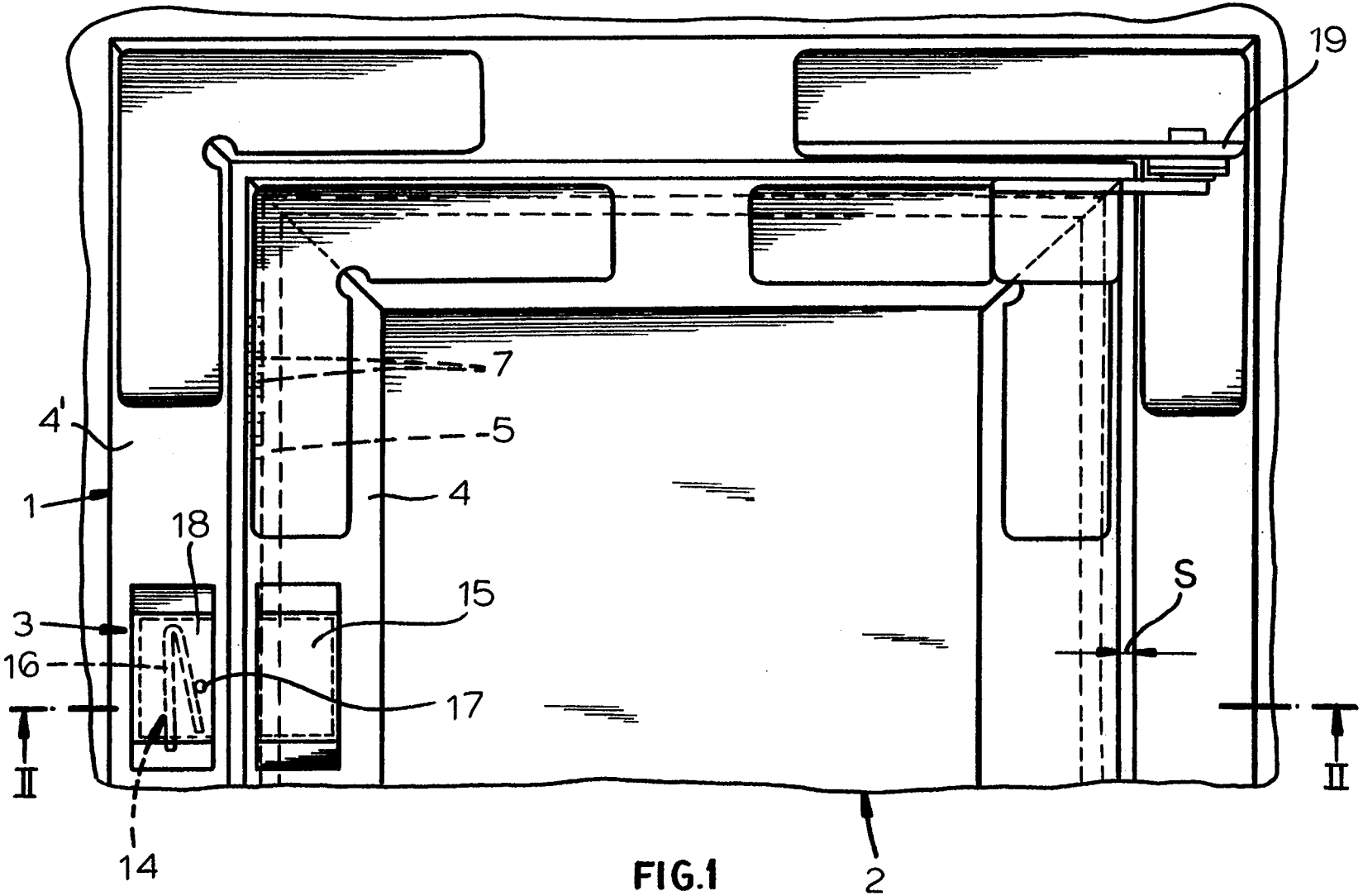
FIG. 1 is a plan view of the firecode access-panel assembly according to the invention.
Figure 2:
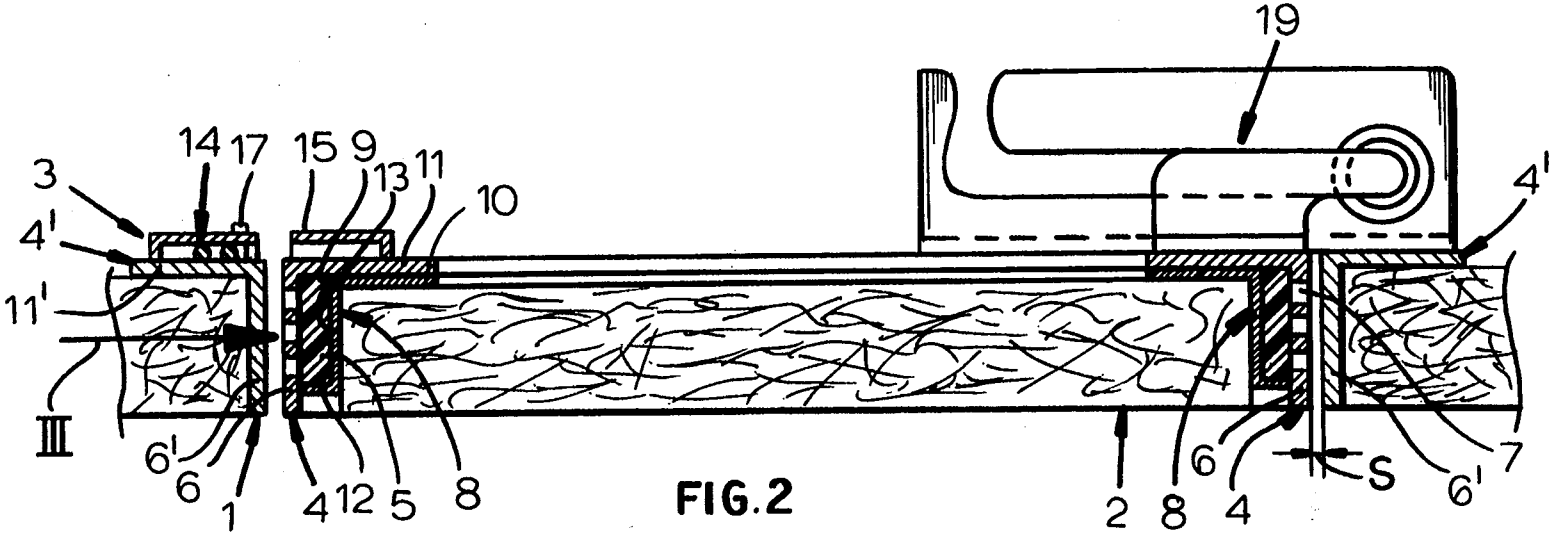
FIG. 2 is a section taken along line II—II of FIG. 1.

As seen in FIGS. 1 and 2 a fireproof wall 1 is formed with an opening in which is positioned a fireproof panel 2, the opening and panel being of geometrically similar rectangular shape. The rectangular outer periphery of the panel 2 and the inner periphery of the door opening are provided with respective L-section frames 4 and 4' having respective outer flanges 11 and 11' lying on the coplanar outer faces of the panel 2 and wall 1 and inner flanges 6 and 6' extending perpendicular to these surfaces and defining an annular space or gap S. Hinges 19 allow the panel 2 to pivot like a door and a latch 3 is provided to hold it shut as described below in greater detail.

Figure 3:
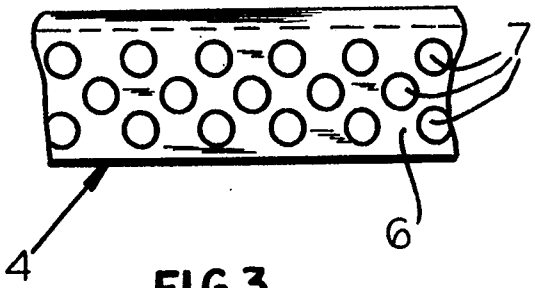

Underneath one of the frames, here under the inner frame 4, is a Z-section bar 8 having an outer flange or web 10 lying under the outer frame flange 11, an inner flange or web 12 extending parallel thereto and butting outwardly on an inside face of the inner flange 6, and a middle web 13 bridging the webs 11 and 12 and extending parallel to but spaced inwardly from the respective inner flange 6 to form therewith an annular compartment 9 containing a body 5 of a heat-foamable resin. The flange 6 is formed as seen in FIG. 3 with a uniform array of through-going circular holes 7, although slots would be equally functional, through which the resin body 5 can extrude when heated to fill the space S.

Figure 4:
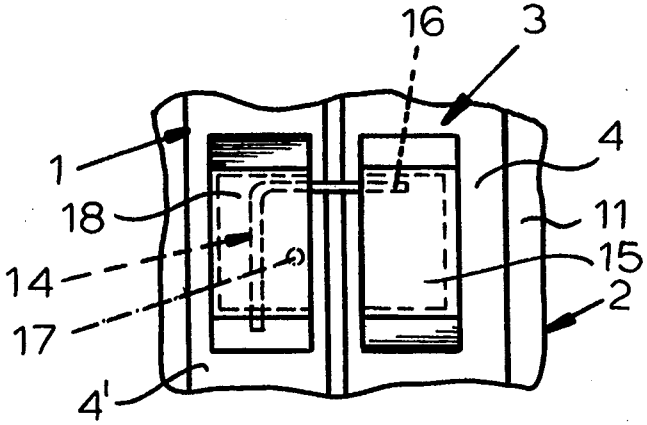
FIGS. 3 and 4 are detail views taken in the direction of respective arrows III and IV of FIG. 2.

The latch 3 comprises a holder 18 on the outer frame 4' and containing a spring 14 having as shown in FIG. 4 a leg 16 that can extend across the space S to lodge in a pocket formed by a strike or keeper 15 provided on the frame 4. A fusible pin 17 in the holder 18 normally keeps the spring 14 folded as shown in FIG. 2, with its arm 16 retained in the holder 14. When heated, this pin 17 melts to release the spring arm 16 and allow it to pop out of the housing 18, thereby locking the door shut.

The foamable mass 5 is held in the compartment 9 and is there very well protected from damage. The total flow cross section of the holes 7 is substantially less than the area of the compartment 9 to ensure this protection, but since the mass 5 is liquefied as it exits through the holes 7 this presents no hindrance to effective operation.

We claim:

1. In a wall having an outer surface and formed with a throughgoing access hole with an inner periphery, a firecode access-panel assembly comprising:

a panel generally fitting in the hole, having an outer surface generally coplanar with the outer surface of the wall, and having an outer periphery running generally parallel to the inner periphery of the hole;

respective geometrically similar inner and outer annular frames on the inner and outer peripheries having confronting outer faces forming a annular gap around the panel between the inner and outer frames, one of the frames being of L-section and having an inner leg defining an inner face and extending generally perpendicular to the wall and panel surfaces and an outer leg lying flat on the respective outer surface, the one frame further having a generally Z-section, stiff, and annular element having:

an outer web lying against the respective outer surface underneath the outer leg of the one frame, an inner web exceeding generally parallel to the surfaces and outwardly butting against the inner face of the one frame, and an intermediate web extending transversely of the surfaces, bridging the inner and outer webs, and extending generally parallel to the inner face, the inner face forming with the element an annular compartment extending around the respective periphery, the inner leg of the one frame being formed with an array of throughgoing openings extending between the respective inner and outer faces, the compartment being substantially closed except at the openings; and an annular body of heat-swellable material wholly contained in the compartment, whereby on heating of the material said annular body swells and exits the compartments through the openings to fill the gap.

2. The firecode access-panel assembly defined in claim 1 wherein the holes are in a regular array extending around the respective periphery.

3. The firecode access-panel assembly defined in claim 1, further comprising latching means actuatable by heat to lock the panel in the hole.

4. The firecode access-panel assembly defined in claim 3 wherein the latching means includes:

a spring mounted on a predetermined one of the frames and having a leg displaceable between a normal position extending from the frame the spring is mounted on across the other frame to block the other frame a holder mounted on the predetermined one of the frames and retaining the spring thereon, and a heat fusible body in the holder normally retaining the spring leg in a retracted position wholly out of the way of the other frame.

5. The firecode access-panel assembly defined in claim 4 wherein the other frame is provided with a strike forming a pocket open toward the guide and receiving the spring leg in the normal position.

* * * * *